US005984742A

United States Patent [19]

Kimura et al.

[11] Patent Number: 5,984,742

[45] Date of Patent: Nov. 16, 1999

[54] OUTBOARD MOTOR ENGINE ARRANGEMENT

[75] Inventors: Sakayuki Kimura; Takahide Watanabe, both of Hamamatsu, Japan

[73] Assignee: Sanshin Kogyo Kabushiki Kaisha, Hamamatsu, Japan

[21] Appl. No.: 08/979,882

[22] Filed: Nov. 26, 1997

[30] Foreign Application Priority Data

Nov. 28, 1996 [JP] Japan ..... 8-317815

[51] Int. Cl.[6] ..... B63H 20/32

[52] U.S. Cl. ..... 440/77; 123/196 W; 440/88

[58] Field of Search ..... 440/77, 88; 123/196 W

[56] References Cited

U.S. PATENT DOCUMENTS 4,917,638 4/1990 Kojima .
5,309,877 5/1994 Shigedomi et al. ..... 123/19.5 P
5,349,928 9/1994 Takahashi et al. .
5,501,188 3/1996 Fukuoka .
5,630,390 5/1997 Tsunoda et al. ..... 123/196 W
5,829,402 11/1998 Takahashi et al. ..... 123/184.24

*Primary Examiner*—Sherman Basinger
*Attorney, Agent, or Firm*—Knobbe, Martens, Olsen & Bear LLP

[57] ABSTRACT

An arrangement for an engine positioned in a cowling of an outboard motor and having an output shaft arranged to drive a water propulsion device of the motor is disclosed. The engine has a first end and a second end and a centerline passing through the ends, at least one combustion chamber, an intake system positioned along a first side of the engine for delivering air to the combustion chamber, a lubricating system including an oil filter for delivering lubricant to the engine and an ignition system including an ignition coil for charging an ignition element corresponding to the combustion chamber. The ignition coil and oil filter are positioned along a second side of the engine opposite the intake system and arranged to reduce the transfer of heat from the filter to the coil, with the oil filter having an outermost portion which is positioned outwardly of the engine between the centerline and a second line which extends parallel to the centerline and passes through an outermost portion of the ignition coil.

7 Claims, 7 Drawing Sheets

OUTBOARD MOTOR ENGINE ARRANGEMENT

FIELD OF THE INVENTION

The present invention relates to an outboard motor. More particularly, the invention is an arrangement for an engine powering an outboard motor, the engine including an ignition coil and oil filter.

BACKGROUND OF THE INVENTION

Watercraft are often powered by an outboard motor positioned at a stem of the craft. The outboard motor has a powerhead and a water propulsion device, such as a propeller. The powerhead includes a cowling in which is positioned an internal combustion engine, the engine having an output shaft arranged to drive the water propulsion device.

Generally, the motor is connected to the watercraft in a manner which permits the motor to be "trimmed" up and down. For example, the motor may be connected through a horizontally extending pivot pin to a clamping bracket which attaches to the watercraft In this manner, the motor may be moved in a vertical plane about the axis of the pin. This allows an operator of the watercraft to raise the propeller out of the water of place it deep in the water dependent upon the trim angle of the motor.

In addition, the motor is arranged to turn left and right about a generally vertically extending axis. This arrangement permits the operator of the watercraft to change the propulsion direction of the motor, and thus change the direction in which the watercraft is propelled.

The size of the motor, especially the powerhead portion which includes the motor, effects the air drag associated with the watercraft. It is desirable for the motor to have a small profile to reduce the air drag. In addition, it is generally desirable for the engine to be compact, since this makes the task of trimming and turning the motor less difficult Several problems arise when reducing the size of the engine to reduce the size of the motor. A primary problem relates to the heat generated by the engine. As stated above, the engine is positioned in a cowling, and as such the heat generated by the engine is trapped in the cowling, resulting in high temperatures within the cowling.

At the same time, in order to reduce the size of the engine, the engine components are generally placed very close to one another. Heat may be transferred between closely positioned components, damaging more heat sensitive components. This problem is especially acute in the outboard motor setting since the temperature in the cowling is already quite high.

An engine arrangement for an engine powering an outboard motor which is compact and reduces the problems associated with the transfer of heat between one or more components is desired.

SUMMARY OF THE INVENTION

The present invention is an engine arrangement for an engine powering an outboard motor. Preferably, the motor is of the type which has a water propulsion device and a cowling. The engine is positioned in the cowling and has an output shaft arranged to drive the water propulsion device of the motor.

The engine has a first end and a second end and a centerline passing through the ends. The engine has at least one combustion chamber and an intake system positioned along one side of the engine for delivering air to the combustion chamber.

A lubricating system delivers oil or a similar lubricant to the engine through an oil filter. The engine also includes an ignition system having an ignition element for initiating combustion in the combustion chamber and a coil for charging the ignition element.

In accordance with the present invention, the ignition coil and oil filter are positioned along a second side of the engine opposite the intake system. The oil filter has an outermost portion which is positioned outwardly of the engine between the centerline and a second line which is parallel to the centerline and which passes through an outermost portion of the ignition coil.

The above-described arrangement provides for a compact engine arrangement, and yet reduces the heat transfer from the hot oil filter to the ignition coil which is positioned closed thereto.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an arrangement for an engine of the type utilized to power a water propulsion device of an outboard motor and positioned in a cowling of the motor. The engine arranged in accordance with the present invention is described for use with an outboard motor since this is an application for which the engine as arranged has particular utility. Those of skill in the art will appreciate that an engine as arranged in accordance with the present invention may be used in a variety of other applications.

Figure 1:
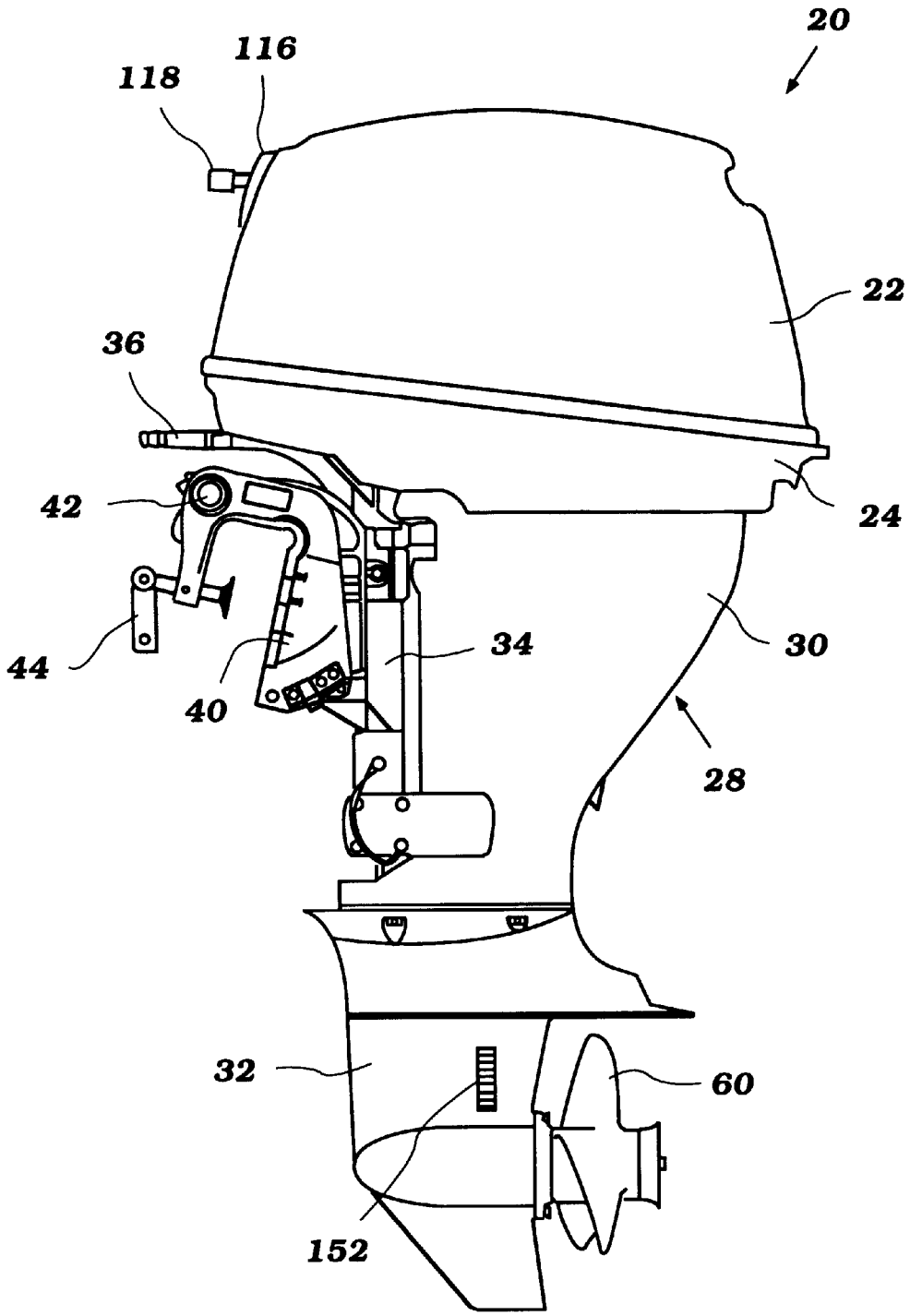
FIG. 1 is a side view of an outboard motor of the type utilized to propel a watercraft, the motor powered by an engine arranged in accordance with the present invention.
Figure 2:
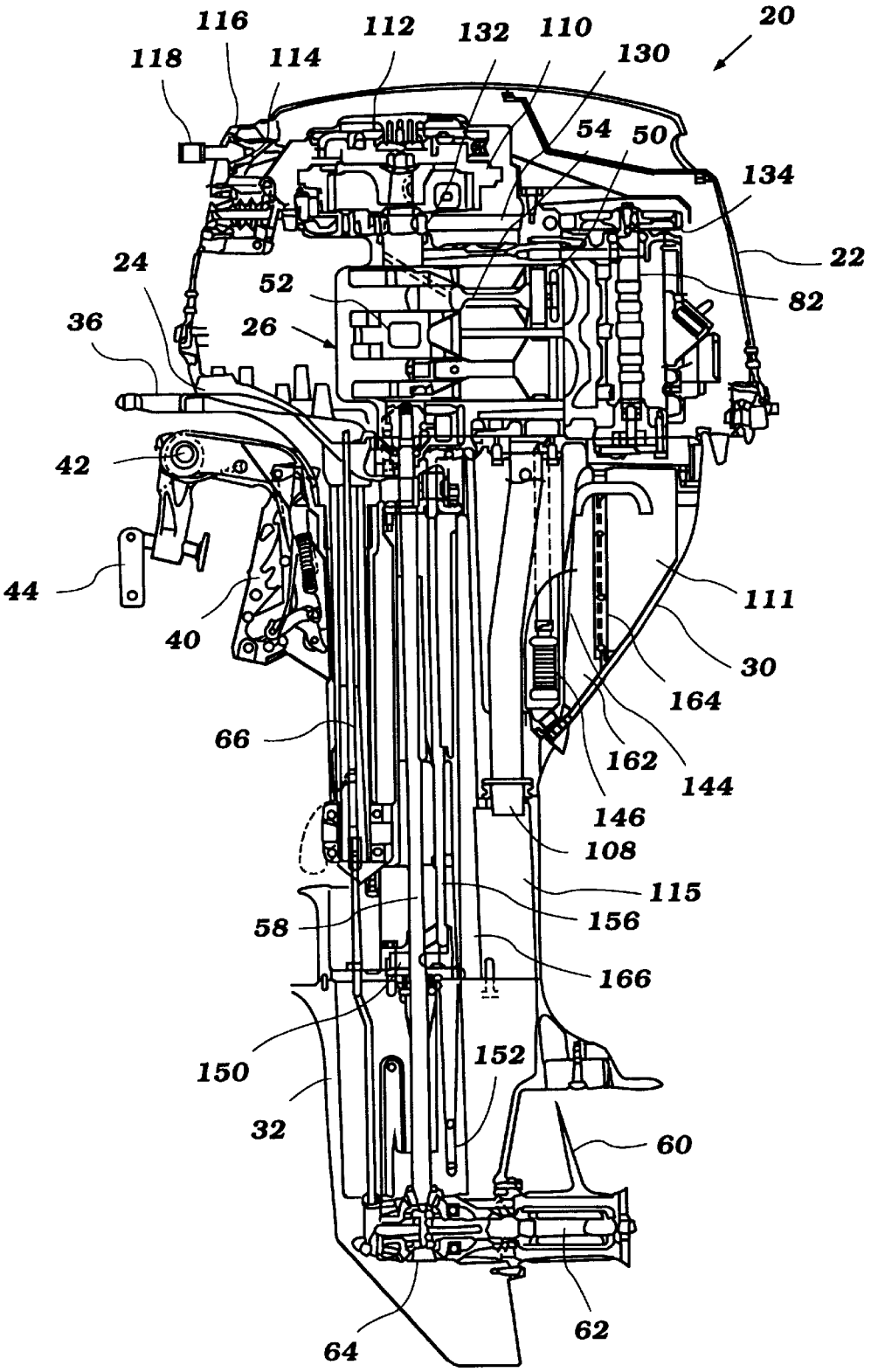
FIG. 2 is a cross-sectional side view of the motor illustrated in FIG. 1.

FIG. 1 illustrates an outboard motor 20 of the type with which the present invention is useful. The outboard motor 20 has a powerhead comprising a main cowling 22 with a lower cowling or tray 24 positioned therebelow. As illustrated in FIG. 2 and described in more detail below, an internal combustion engine 26 is positioned in the powerhead.

A drive shaft housing or lower unit 28 depends below the powerhead. The drive shaft housing 28 comprises an upper casing 30 and a lower casing 32 positioned below the upper casing.

The outboard motor 20 is arranged to be movably connected to a hull of a watercraft (not shown), preferably at a transom portion of the watercraft at a stem thereof. In this regard, a steering shaft (not shown) is connected to the drive shaft housing 28 portion of the motor 20. The steering shaft preferably extends along a vertically extending axis through a swivel bracket 34. The mounting of the steering shaft with respect to the swivel bracket 34 permits rotation of the motor 20 about the vertical axis through the bracket 34, so that the motor may be turned from side to side.

A steering handle 36 is connected to the bracket 34. An operator of the motor 20 may move the outboard motor 20 from side to side with the handle 36, thus steering the watercraft to which the motor is connected.

The swivel bracket 34 is connected to a clamping bracket 40 by means of a pivot pin 42 which extends along a generally horizontal axis. The clamping bracket 40 is arranged to be removably connected to the hull of a watercraft with a clamping screw 44 or similar mechanism. The mounting of the motor 20 with respect to the clamping bracket 40 about the pin 42 permits the motor 20 to be raised up and down or "trimmed."

As described above, an engine 26 is positioned in the powerhead The engine 26 is preferably of the two-cylinder variety, arranged in in-line fashion and operating on a fourcycle principle. As may be appreciated by those skilled in the art, the engine 26 may have a greater or lesser number of cylinders, may be arranged in other than in-line fashion and may operate on other operating principles, such as a two-cycle principle.

Figure 4:
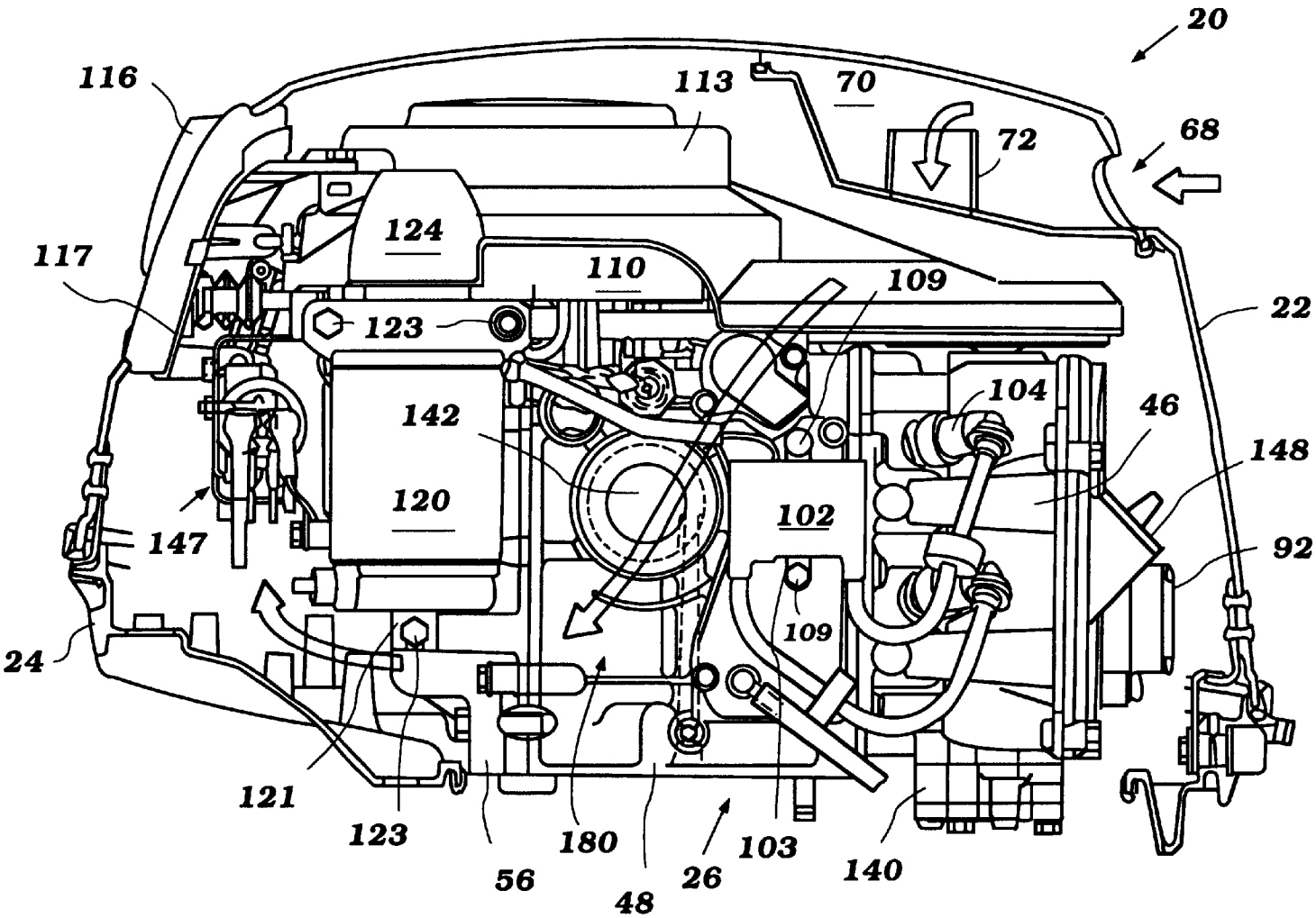
FIG. 4 is an enlarged cross-sectional view of a first side of a top portion of the motor illustrated in FIG. 1.

Referring to FIGS. 2 and 4, the engine 26 preferably comprises a cylinder head 46 connected to a cylinder block 48 and cooperating therewith to define two cylinders. A piston 50 is movably positioned in each cylinder 48 and connected to a crankshaft 52 via a connecting rod 54.

As best illustrated in FIG. 2, the crankshaft 52 is generally vertically extending. As such, the cylinders, and thus the pistons 48, extend in a horizontal direction. The crankshaft 52 is mounted for rotation with respect to the remainder of the engine 26 within a crankcase chamber defined by the cylinder block 48 and a crankcase cover 56 connected thereto. As illustrated, the crankcase cover 56 is positioned at the opposite end of the cylinder block 48 from the cylinder head 46. Preferably, the cylinder head end of the engine 26 is positioned within the main cowling 22 farthest from a watercraft when the motor 20 is attached thereto, and the crankcase end of the engine 26 is thus closest to a watercraft when the motor 20 is attached thereto.

The crankshaft 52 extends below a bottom of the engine 26 in the direction of the drive shaft housing 28, where it is coupled to a drive shaft 58. The drive shaft 58 extends through the drive shaft housing 28 and is arranged to drive a water propulsion device of the motor 20. As illustrated, the water propulsion device is a propeller 60.

In the preferred arrangement, the drive shaft 58 is arranged to selectively drive a propeller shaft 62 through a forward-neutral-reverse transmission 64. The propeller 60 is connected to an end of the propeller shaft 62 opposite the transmission 64. Preferably, the position of the transmission 64 is controlled by a shift rod 66 extending through the drive shaft housing 28 to the transmission 64 from a transmission control (not shown) which the operator of the motor 20 manipulates.

An intake system provides air to each cylinder of the engine 26 for the combustion process. As illustrated in FIG. 4, air is drawn through a vent 68 in the main cowling 24 into an inlet area 70 formed by the main cowling 24. Air then flows through an upwardly extending air inlet pipe 72 into the interior of the cowling in which the engine 26 is positioned. The above-described arrangement serves to reduce the flow of water and the like through the vent 68 into the portion of the cowling 22 which houses the engine 26. In the preferred embodiment, a similar intake pipe 73 leads from the inlet area 70 into the engine compartment on the opposite side of the cowling 22 (see FIG. 3).

Figure 3:
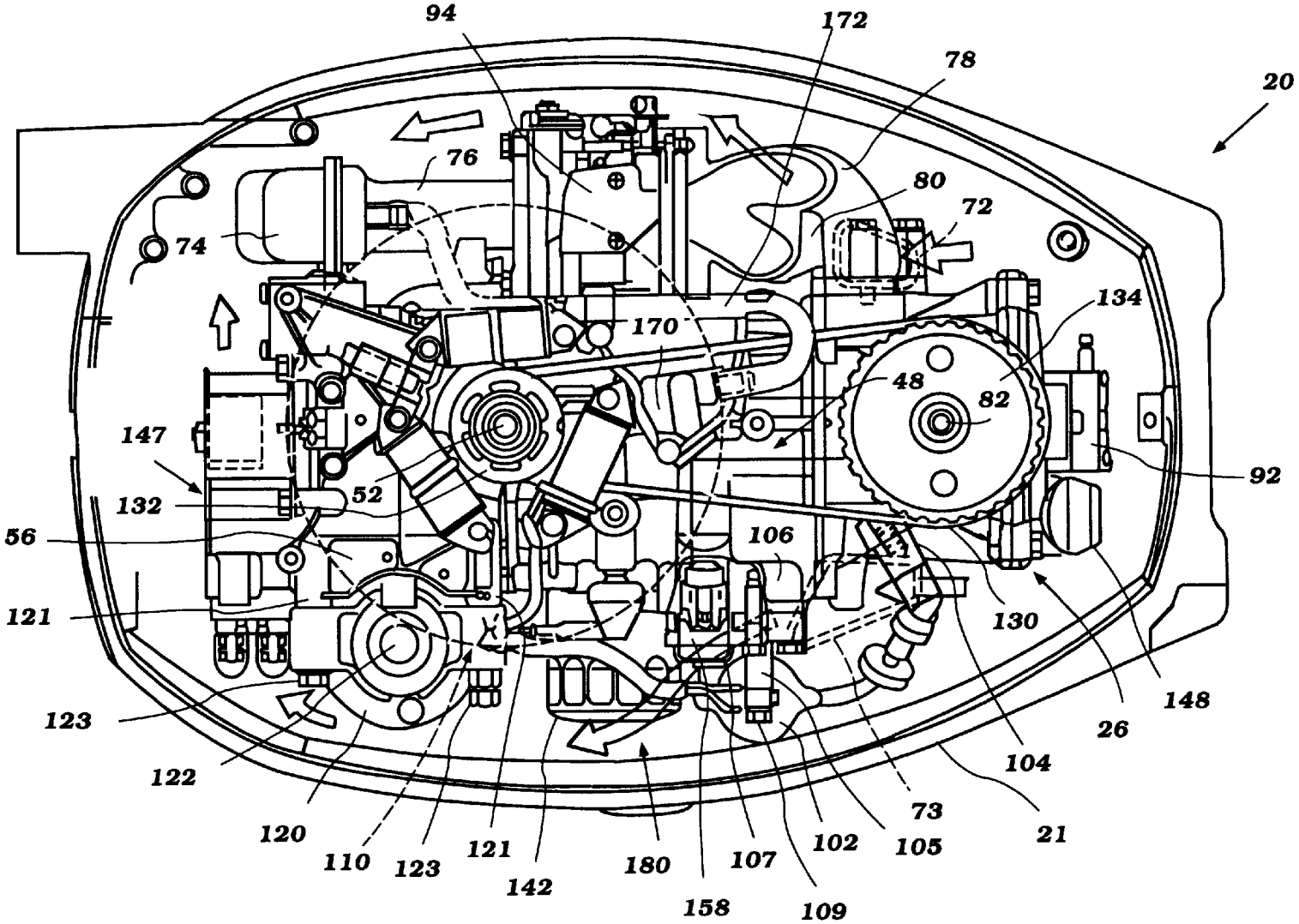
FIG. 3 is a top view of the motor illustrated in FIG. 1 with a main cowling and a flywheel cover removed, exposing a top end of the engine.
Figure 5:
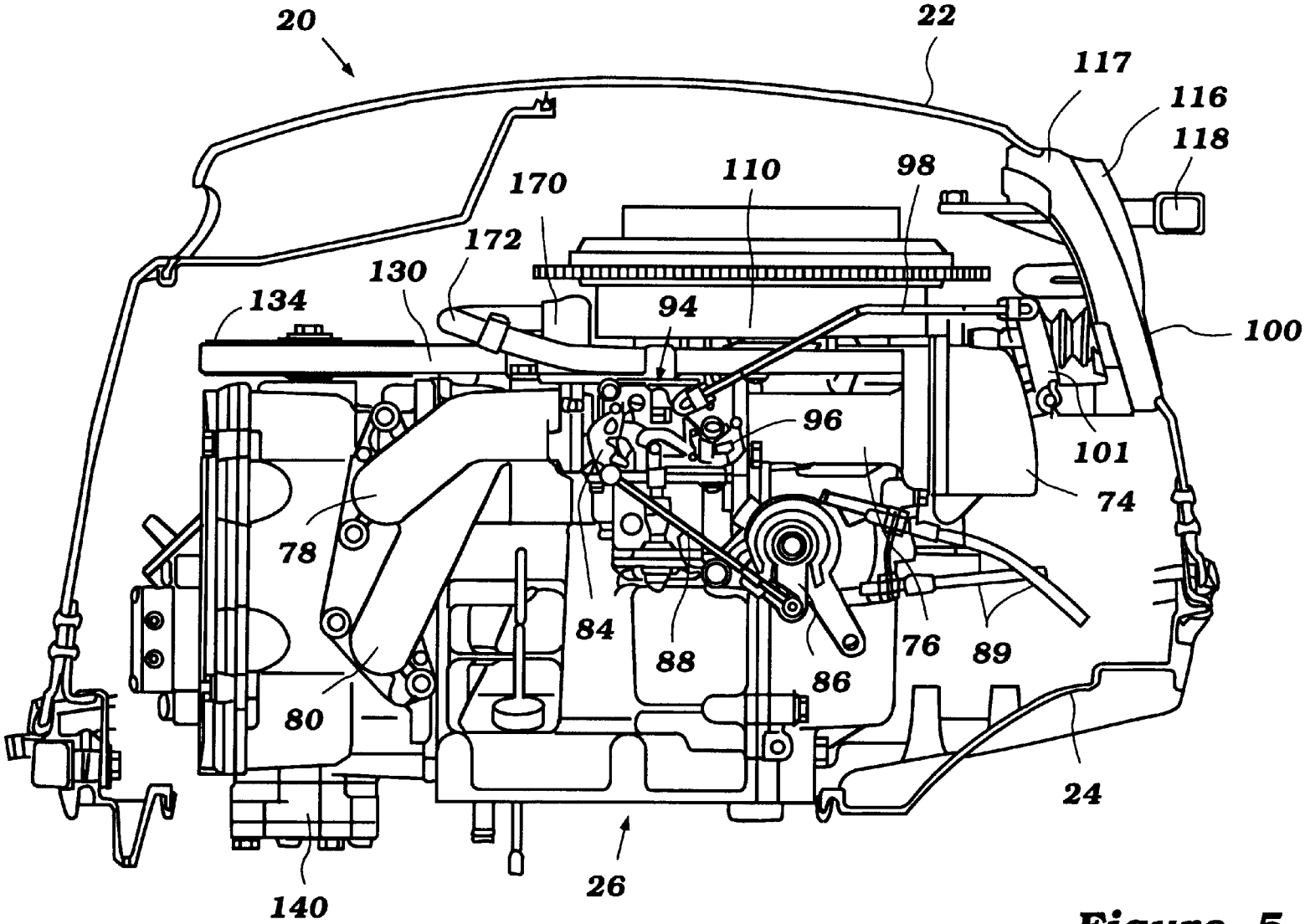
FIG. 5 is an enlarged cross-sectional view of a second side of a top portion of the motor illustrate FIG. 1 and with a flywheel cover of the engine removed.
Figure 7:
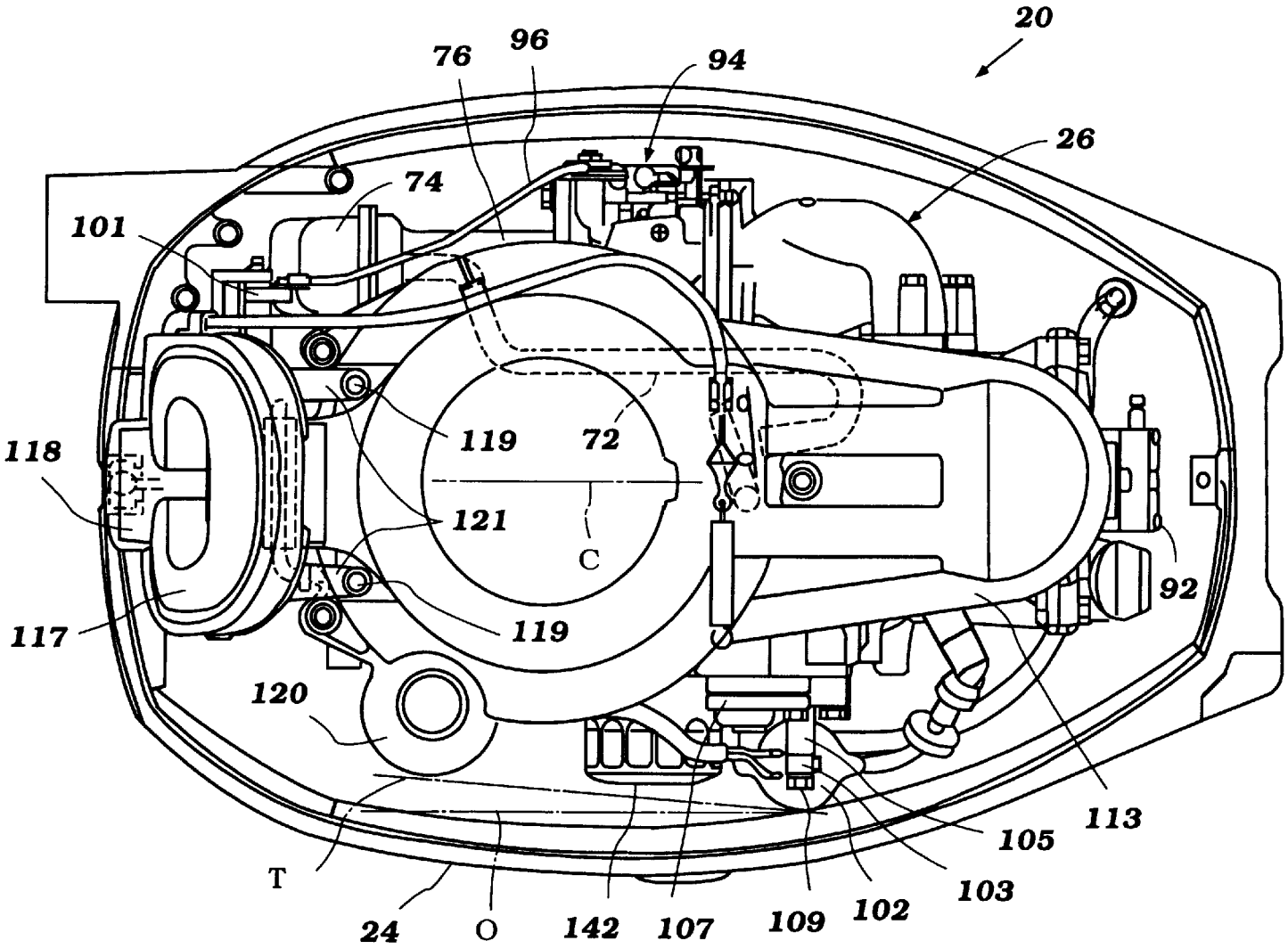
FIG. 7 a top view of the motor illustrated in FIG. 1, with a portion of a main cowling removed, exposing the engine therein.

Referring now to FIGS. 3, 5 and 7, air within the main cowling 22 is drawn into a silencer 74. The air is then drawn from the silencer 74 through an intake pipe 76 to a pair of branch pipes 78,80. The branch pipes 78,80 are connected to the cylinder head 46 of the engine 26 and each have a passage therethrough aligned with a corresponding passage through the cylinder head 46 leading to one of the cylinders. In this manner, air flows through the intake pipe 76 and respective branch pipes 78,80 to each cylinder.

In the embodiment illustrated, the intake pipe 76 and branch pipes 78,80 preferably extend along a first side of the engine 26 from the crankcase chamber end towards the cylinder head end, generally below a top of the engine.

Preferably, means are provided for controlling the flow of air into each cylinder in a timed manner. Though not illustrated, this means may comprise an intake valve positioned in each intake passage leading through the cylinder head 46 to a cylinder. In such an arrangement, each intake valve is preferably actuated between open and closed positions, as known to those of skill in the art, by at least one camshaft 82 (see FIG. 1).

Means are also provided for controlling the rate of air flow through the intake system to each cylinder. Preferably, this means comprises a throttle valve (not shown) positioned in the intake pipe 76. Referring to FIG. 5, the throttle valve is preferably actuated by a throttle lever 84. This lever 84 is connected to a pivot lever 86 via a throttle link 88. A throttle actuator wire 89 is connected to the pivot lever 86 for moving the pivot lever 86, the wire 89 extending to an operator-engaged throttle control (not shown) of a type well known to those skilled in the art.

A fuel system provides fuel to each cylinder for combustion with the air. The fuel system draws fuel from a fuel supply (not shown) such as a fuel tank positioned in the hull of the watercraft to which the motor 20 is connected. Preferably, as illustrated in FIG. 4, the fuel is drawn by a fuel pump 92. The fuel pump 92 delivers the fuel through a fuel line to a charge former. In the preferred embodiment, the charge former comprises a carburetor 94.

As illustrated, the carburetor 94 is positioned along the intake pipe 76 for introducing fuel into the air passing therethrough. In this manner, a combined air and fuel charge is delivered through the branch pipes 78,80 to the cylinders. Though not described herein, those of skill in the art will appreciate that other charge formers such as fuel injectors may be used. In addition, a carburetor may be provided corresponding to an intake pipe leading to each cylinder instead of a single carburetor for all cylinders as in the illustrated embodiment.

The carburetor 94 is preferably arranged so that the movement of the throttle lever 84 effectuates a change in the rate of air and fuel delivery, as is known to those of skill in the art. A choke lever 96 is also associated with the carburetor 94 and controls the position of a choke valve (not shown) which is movably positioned in the intake pipe 76. The choke lever 96 is actuated through a choke link 98 from a choke knob 100. Preferably, the knob 100 is positioned externally to the main cowling 22 at the end of the motor 20 which is closest the watercraft for engagement by an operator of the watercraft. More particularly, the knob 100 is mounted to the combination guide and mount 116 connected to the cowling 22.

Referring to FIG. 5, an offset linkage mechanism 101 is provided between a rod which is associated with the knob 100 and the link 98 for transmitting a force applied to the knob 100 to the link 98 for actuating the choke valve.

The engine 26 includes an ignition system. Such systems are well known to those of skill in the art, and thus the system is not described in detail herein. Preferably, however, the system includes a powered ignition coil 102 which delivers a charge at a predetermined time to a spark plug 104 corresponding to each cylinder. Each spark plug 104 has its tip positioned in the cylinder, and when the charge is delivered to the spark plug, effects a spark across an electrode tip thereof to initiate the combustion of the air and fuel mixture in the cylinder.

In the embodiment illustrated, the ignition coil 102 has a pair of mounting parts 103 extending from a housing thereof The mounting parts 103 are connected to a pair of bosses 105 extending from a cover element 107. As described in more detail below, the cover element 107 defines a coolant passage 158 through which coolant flows for cooling a portion of an exhaust system. Preferably, a bolt 109 engages each mounting part 103 of the coil 102 and a corresponding boss 105.

Referring to FIGS. 2 and 3, an exhaust system is provided for routing exhaust from each cylinder. Preferably, an exhaust passage (not shown) leads through the cylinder head 46 from each cylinder. Each passage leads to a passage through an exhaust manifold 106 connected to the cylinder head 46. Preferably, the manifold 106 is arranged to route exhaust gases to an exhaust pipe 108 which extends below the engine 26 into the drive shaft housing 28. The exhaust pipe 108 terminates in a first expansion chamber or muffler 115. When the engine speed is low and the exhaust back-pressure is low, the exhaust is preferably routed to a second expansion chamber 111 and then through an above the water exhaust gas discharge. When the engine speed is higher and the exhaust pressure is high, the exhaust is preferably routed from the expansion chamber 115 through a through-the-hub (of the propeller) discharge into the body of water in which the motor 20 is operating.

As with the intake system, valve means are preferably provided corresponding to each cylinder for controlling the flow of exhaust therefrom. Although not illustrated, these means may comprise an exhaust valve associated with each cylinder and movable between one position in which exhaust is permitted to flow through the exhaust passage therefrom, and a second position in which the exhaust is not permitted to flow from the cylinder. The same camshaft 52 which is used to control the intake valves may be used to control the exhaust valves. Alternatively, and as known to those of skill in the art, a separate exhaust camshaft may be provided for actuating only the exhaust valves.

A starter mechanism is provided for use in starting the engine 26. Referring to FIGS. 2 and 4, the starter mechanism preferably includes a recoil type starter. In this arrangement, the crankshaft 52 extends above a top end of the engine 26. A flywheel 110 is connected to the portion of the crankshaft 52 extending above the engine 26.

A recoil starter mechanism 112 of a type known to those of skill in the art is preferably associated with the flywheel 110. The recoil starter mechanism 112 is positioned above the flywheel 110, but under a starter mechanism/flywheel cover 113.

A starter cord 114 extends from the recoil mechanism through a combination cord guide and mounting 116 which extends through the main cowling 22. A seal 117 is preferably provided between the cord guide 116 and the cowling 22 for providing an air and water tight seal therebetween.

A handle 118 is connected to the end of the cord 114 which extends through the guide 116. In this arrangement, when the operator of the watercraft pulls on the handle 118 and extends the cord 114, the flywheel 110 is rotated, starting the engine 26.

When this type of starting mechanism is employed, the ignition system preferably includes a magneto-type generator which generates power for powering the ignition coil 102 without the need for a battery.

As best illustrated in FIG. 7, the combination guide and mount 116 and recoil mechanism cover 113 are connected securely to one another through a pair of bolts 119. The bolts 119 extend through a pair of spaced flanges 121 extending from the guide 116 towards the cover 113, and into the cover 113 itself.

The motor 20 may also be provided with an electrically powered starter motor 120 for those instances where a battery is available. Referring to FIGS. 3 and 4, the starter motor 120 is preferably mounted along a side of the engine 26 with a pinion gear 122 arranged to drive the flywheel 110. A cover 124 is mounted over the pinion gear 122.

The motor 120 is preferably mounted to several mounting flanges or bosses 121 extending from the crankcase cover 56, as best illustrated in FIGS. 3 and 4. The motor 120 includes one or more corresponding mounting areas. In the embodiment illustrated, a bolt 123 engages each mounting area of the starter motor 120 and a corresponding boss 121. Of course, the starter motor 120 may be mounted in a variety of other manners as appreciated by those of skill in the art.

When an electric starter 120 is provided, a starter button 125 is preferably mounted to the mount 116 on the exterior of the main cowling 22, near the choke button 100.

Means are provided for driving the camshaft 82. As illustrated in FIG. 2, the camshaft 82 is preferably driven by the crankshaft 52 by means of a flexible transmitter such as a chain or belt 130. A drive pulley 132 is connected to the portion of the crankshaft 52 which extends above the top end of the engine 26. Preferably, the drive pulley 132 is mounted below the flywheel 110. A driven pulley 134 is connected to an end of the camshaft 82 also extending above the top end of the engine. The drive belt 130 extends in engagement with the two pulleys 132,134, whereby rotation of the crankshaft 52 effectuates rotation of the camshaft 82.

The motor 20 includes a number of sub-systems relating to the engine 26. First, a lubricating system provides lubricant to one or more parts of the engine 26 for lubricating them. The lubricating system includes means for drawing lubricant from a lubricant supply and delivering it to the engine 26. In the embodiment illustrated, the supply is located in an oil pan 144 positioned below the engine 26 in the drive shaft housing 28.

Preferably, the means for delivering lubricant comprises an oil pump 140. Referring to FIGS. 4 and 5, the lubricant pump 140 is positioned below the engine 26 and is preferably driven by an end of the camshaft 82 extending below the engine. The pump 140 draws lubricant upwardly towards the engine 26 through a filtered inlet 146 positioned in the oil pan 144.

The pump 140 delivers lubricant from the supply through a filter 142. The lubricant then flows through one or more passages or galleries through the engine 26 for lubricating the various parts thereof, as well known to those of skill in the art The lubricant preferably drains downwardly through one or more drain passages to the lubricant or oil pan 144 for re-delivery to the engine.

Referring to FIG. 3, an oil fill port 148 is preferably provided at the end of the engine 26 where the cylinder head 46 is positioned. The oil fill portion 148 is provided in communication with the oil pan 144 through the drain lines, whereby an operator of the motor 20 may add lubricant to the lubricating system.

Figure 6:
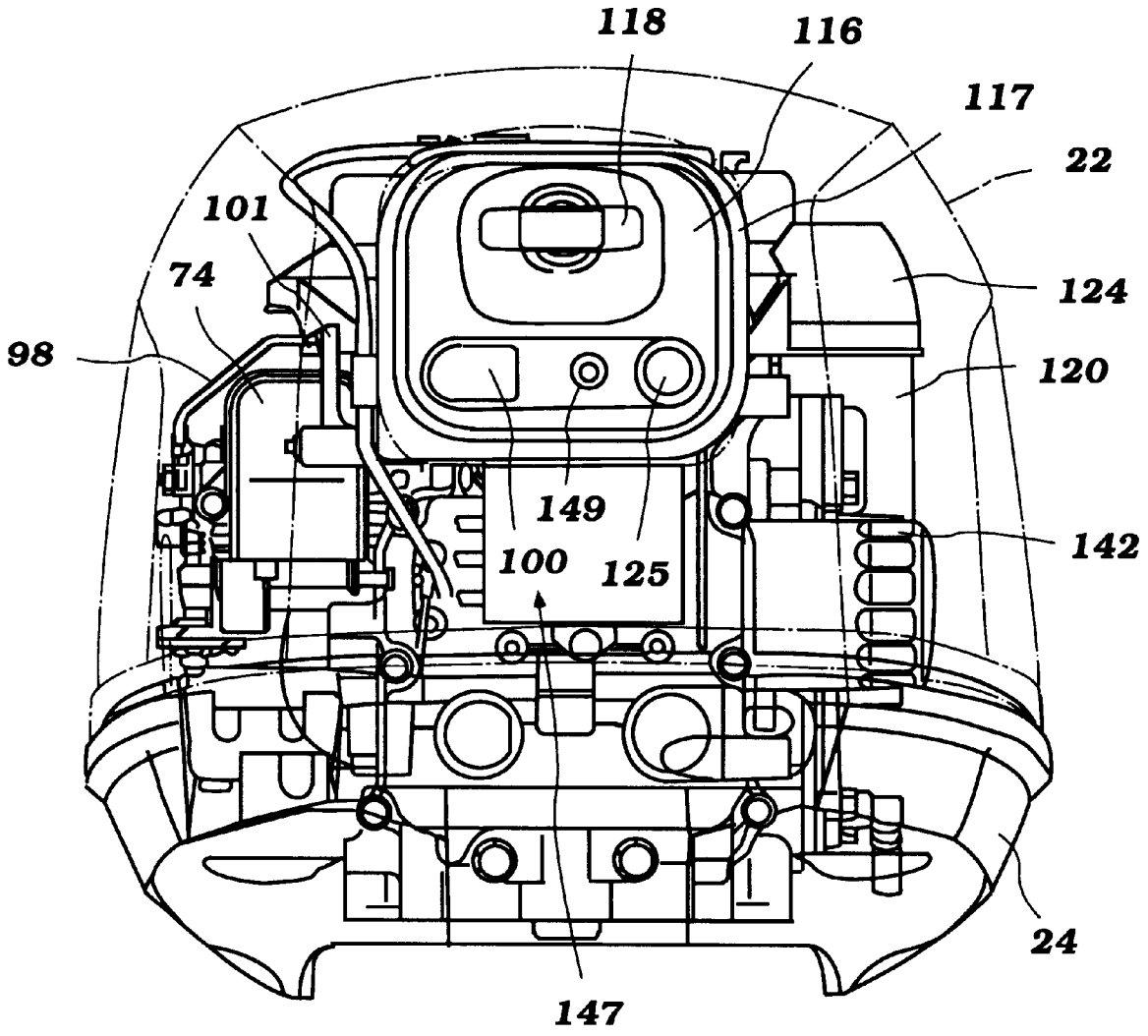
FIG. 6 is an end view of the engine powering the motor illustrated in FIG. 1, with a portion of the cowling enclosing the engine illustrated in phantom.

The lubricating system includes means for providing a warning of a lubricant system malfunction or undesirable condition. Referring to FIG. 6, a lubricant system warning lamp 149 is preferably provided on the mounting part 117 adjacent the choke knob 100. The lamp 149 may be arranged to illuminate when a lubricant sensor indicates that the lubricant level in the pan 144 is low, or the lubricant pressure in the lubricant system is too low or too high, or when other similar undesirable lubricating system conditions arise as known to those of skill in the art.

This warning system may include electronics 147 which are mounted at the crankcase end of the engine 26 adjacent the starter motor 120. These electronics 147 may also include other electrical system components such as relays and the like which comprise portions of the starting, ignition or other systems.

A cooling system is provided for cooling one or more parts of the engine 26. The cooling system includes means for delivering coolant to the engine 26. Referring to FIG. 1, this means preferably comprises a coolant pump 150. The coolant pump 150 is positioned in the drive shaft housing 28 and driven by the drive shaft 58.

The coolant pump 150 draws water from the body of water in which the motor 20 is operating through an inlet 152 in the lower case 32 of the drive shaft housing 28. This coolant is delivered upwardly through the drive shaft housing 28 to the engine 26 through a coolant delivery line 156.

The coolant is delivered through one or more coolant passages or jackets, such as passages in the cylinder head 46 and block 48 and the passage 158 arranged to cool a portion of the exhaust system, for cooling various parts of the engine 26. The coolant preferably drains through a drain line from the engine 26 into a coolant pool 162 located in the drive shaft housing 28. The coolant pool 162 is preferably positioned adjacent the oil pan 144 and separated from the second expansion chamber 111 by a dividing wall 164.

The coolant drains from the pool 162 (such as over an overflow weir, not shown) through a drain passage 166 to a discharge through the drive shaft housing 28 back to the body of water in which the motor 20 is operating.

The cooling system may be provided with one or more thermostats (not shown) as known to those of skill in the art for use in controlling the flow of coolant through the engine 26. For example, a thermostat may be provided for limiting the flow of coolant through the engine 26 when the engine temperature is low, permitting the engine 26 to warm up.

The cooling system may also include a pressure relief valve (not shown) for diverting coolant from the cooling system in the event the pressure in the system exceeds a predetermined high pressure.

Referring to FIGS. 3 and 5, the engine 26 includes a crankcase pressure relief system. This system includes a crankcase breather element 170 which is connected to the crankcase cover 56. The element 170 has a passage therethrough which is in communication with the crankcase chamber and a by-pass line 172 leading to the intake system. The element 170 is preferably positioned at the top end of the engine 26 adjacent the flywheel 110, as best illustrated in FIG. 3.

The breather element 170 preferably includes a one-way valve which permits gas under high pressure in the crankcase to flow therethrough to the by-pass line 172, but which prevents the flow of gas into the crankcase chamber. The line 172 preferably comprises a hose which extends from the element 170 to the silencer 74.

The relief system works as follows. During the cylinder compression and combustion processes, some of the air and fuel charge passes between the exterior of the piston and the portion of the cylinder block 28 which defines the cylinder in which the piston 50 is moving. This gas raises the pressure in the crankcase, such that when the piston 50 moves downwardly, the high pressure in the crankcase makes more difficult the movement of the piston. As the pressure within the crankcase exceeds a predetermined level, gas is diverted through the element 170 to the air intake. This gas is then redelivered to the engine 26 with air drawn into the silencer 74 from within the cowling 22.

In accordance with the present invention, the engine 26 and its related components are preferably arranged to provide for a compact layout. This permits the overall size of the powerhead of the motor 20 to be small. The small powerhead reduces the air drag associated with the motor 20 and makes less difficult the task of trimming and turning the motor.

In the preferred arrangement illustrated, and as described in detail above, the engine 26 is positioned in the main cowling 22 with the crankcase cover 56 and cylinder head 46 positioned at opposite ends of the engine 26 and along a centerline or longitudinal axis C passing therethrough from end-to-end. This centerline C extends generally parallel to a centerline of a watercraft when the motor 20 is connected thereto and not turned to either side. In this arrangement, when the motor 20 is connected to a watercraft, the crankcase cover 56 is at the end of the engine 26 which is closest to the watercraft.

Preferably, the intake system is positioned along a first side of the engine 26 between its ends. As described above, the silencer 74 is positioned along the side of the engine near the crankcase. The intake pipe 76 extends along the side of the engine 26 from the silencer 74 towards the cylinder head 46 at the opposite end.

The oil filter 142 and ignition coil 102 are positioned on the opposite or second side of the engine 26 from the intake system. This arrangement lends to a compact arrangement, and to an engine which is generally symmetric on either side of the centerline C. The oil filter 142 and ignition coil 102 are arranged, however, so as to limit the heat transfer from the oil filter 142 to the ignition coil 102 to extend the working life of the coil.

As illustrated, the ignition coil 102 extends outwardly of the engine 26 to a line O which is generally parallel to the centerline C. The oil filter 142 extends outwardly of the engine 26 (i.e. in a direction away from the centerline C) a distance which is less than the distance the line O is located from the centerline C. In other words, the outermost portion of the filter 142 is positioned inwardly towards the centerline C from the line O, and thus between the centerline C and line O.

More particularly, the outermost portion of the filter 142 is positioned inwardly of a tangent line T which passes through the outermost portion of the ignition coil 102 and the outermost portion of the starter motor 120 also positioned along the side of the engine 26 on the opposite side of the filter 142 from the coil 102.

In this arrangement, an air flow path 180 (see FIGS. 3 and 4) is defined from the air intake 73 provided generally above the ignition coil 102, downwardly between the main cowling 22 and the engine 26, including the filter 142 and coil 102. This air serves to cool the filter 142.

In the embodiment illustrated, the ignition coil 102 has a generally cylindrical shape and is oriented so that an axis extends vertically therethrough. The starter motor 120 also has a generally cylindrical outer shape and is oriented vertically. The oil filter 142, on the other hand, is cylindrical but has its axis extending in a horizontal plane. Of course, the filter 142, motor 120 and ignition coil 102 may have a variety of other shapes and be arranged in other directions, although when shaped and oriented as described, the above-stated stated positioning of the filter 142 with respect to the coil 102 is particularly advantageous in reducing the heat transfer from the filter 142 to the ignition coil 102.

Of course, the foregoing description is that of preferred embodiments of the invention, and various changes and modifications may be made without departing from the spirit and scope of the invention, as defined by the appended claims.

What is claimed is:

1. An outboard motor having a cowling and a water propulsion device, an internal combustion engine positioned in said cowling and arranged to propel said water propulsion device, said engine having a first end and a second end and a centerline passing through said ends, at least one combustion chamber, an intake system for delivering air to said combustion chamber, said intake system positioned along a first side of said engine, a lubricating system for delivering lubricant to said engine, said lubricating system including an oil filter, and an ignition system including an ignition element for initiating combustion in said combustion chamber, said ignition system including an ignition coil, said ignition coil and oil filter positioned along a second side of said engine opposite said first side, said ignition coil having an outermost portion positioned along a second line extending parallel to said centerline and spaced therefrom, said oil filter having an outermost portion positioned outwardly of said engine between said centerline and said second line.

2. The outboard motor in accordance with claim 1, further including a starter motor positioned along said second side of said engine and having an outermost portion positioned away from said centerline a lesser distance than said outermost portion of said ignition coil, and wherein said outermost portion of said oil filter is positioned between said centerline and a third line extending between said outermost portion of said starter motor and ignition coil.

3. The outboard motor in accordance with claim 1, wherein said oil filter is positioned between said starter motor and said ignition coil.

4. The outboard motor in accordance with claim 1, further including an air inlet defined through said cowling generally above said second side of said engine, whereby an air flow path is defined from said inlet between said oil filter and said cowling within said cowling.

5. An outboard motor having a cowling and a water propulsion device, an internal combustion engine positioned in said cowling and having a generally vertically extending output shaft in driving relation with said water propulsion device, said engine having a first end and a second end and a centerline passing through said ends, at least one combustion chamber, an intake system for delivering air to said combustion chamber, said intake system positioned along a first side of said engine, a lubricating system for delivering lubricant to said engine, said lubricating system including an oil filter, and an ignition system including an ignition element for initiating combustion in said combustion chamber, said ignition system including an ignition coil, a cooling air flow path defined from an air intake through said cowling between an inside of said cowling and an outer periphery of said oil filter, said outer periphery of said oil filter positioned inwardly of a second line extending generally parallel to said centerline and passing through an outermost portion of said ignition coil.

6. The outboard motor in accordance with claim 5, wherein said filter is generally cylindrical in shape and has first and second ends and an axis passing through said ends, said axis extending generally perpendicular to said output shaft and said centerline of said engine.

7. The outboard motor in accordance with claim 5, wherein said oil filter is cylindrical and has a generally circular end facing outwardly from said engine.

* * * * *